US005172719A

United States Patent [19]

Dawawala et al.

[11] Patent Number: 5,172,719

[45] Date of Patent: Dec. 22, 1992

[54] STEAM TURBINE CONTROL VALVE

[75] Inventors: Suryakant K. Dawawala, Casselberry; Jim G. Schwartz, Winter Park, both of Fla.

[73] Assignee: Westinghouse ELectric Corp., Pittsburgh, Pa.

[21] Appl. No.: 732,968

[22] Filed: Jul. 19, 1991

[51] Int. Cl.[5] ..... F16K 43/00

[52] U.S. Cl. ..... 137/315; 251/63.6

[58] Field of Search ..... 92/130 B, 130 D; 251/63.6, 63.5; 137/315

[56] References Cited

U.S. PATENT DOCUMENTS

| | | | |
|---|---|---|---|
| 229,644 | 7/1880 | Spiller | 251/63.6 |
| 630,754 | 10/1899 | Snyder | 251/63.6 |
| 3,602,261 | 8/1971 | Brown . | |
| 3,656,708 | 4/1972 | Hobbs | 251/63.6 |
| 3,672,628 | 6/1972 | Aanstad | 251/63.6 |
| 3,687,017 | 8/1972 | Lewis et al. | 251/63.6 |
| 3,726,187 | 4/1973 | Lewis | 91/468 |
| 4,103,864 | 8/1978 | Hagendorn | 251/63.6 |
| 4,431,159 | 2/1984 | Stubbs | 251/63.6 |
| 4,834,133 | 5/1989 | LaCoste et al. | 137/315 |

*Primary Examiner*—George L. Walton

[57] ABSTRACT

A control valve for use in the steam chest of a steam turbine is provided. Considerable stiffness is imparted to the valve by employing a large diameter spring housing which encloses the valve springs. In addition, the bonnet of the valve is oversized and the screws attaching the bonnet to the steam chest are arranged in a circle inside the spring housing, thereby allowing the spring housing to be attached to the bonnet by a plurality of screws arranged in a large circle around the outside of the spring housing. The spring housing lower flange engages a spigot on the bonnet in a tight fit. The spring seat slides within the spring housing and has integral lugs which extend through windows in the spring housing. The lugs allow the spring seat to be restrained to the upper flange of the spring housing so that the coupling connecting the valve actuator piston rod to the valve steam can be assembled and disassembled during installation and maintenance.

17 Claims, 4 Drawing Sheets

STEAM TURBINE CONTROL VALVE

FIELD OF THE INVENTION

The current invention relates to a control valve. More specifically, the invention relates to a spring operated control valve mounted on the steam chest of a steam turbine.

BACKGROUND OF THE INVENTION

In steam turbines, the admission of steam to the inlet of the turbine is regulated by a series of control valves. To minimize throttling losses, such valves are sequentially opened and closed to regulate the flow of steam. Typically, such valves are mounted in a row along a steam chest which is in flow communication with the turbine inlet. Control valves are commonly hydraulically operated. However, since it is important to rapidly close the valves in the event of a turbine "trip", one or more springs are utilized to assist the hydraulic actuator to rapidly close the valve.

A typical steam turbine control valve 100 of the type previously known in the art is shown in FIGS. 1 and 2. The valve 100 is mounted via a bonnet 110 to a steam chest 111. A support post 107 extends upwardly from the bonnet 110 and terminates in a flange 101. A valve stem assembly, which includes the piston rod 113 of a hydraulic actuator 114 is disposed within the post 107. Inner and outer springs 108 and 109, respectively, surround the post 107 and are disposed between the flange 101 and a circular spring seat 102. The spring seat 102 has a circular hole 119 formed therein through which the post 107 extends, so that the spring seat is free to slide along the exterior of the post. A rectangular bar 104 is attached to the underside of the spring seat 102 by screws 105. The bar 104 extends through windows 106 formed in the post 107, so as not to interfere with the motion of the spring seat 102. The bar 104 rests on an annular washer 117 which rests on a seat 118 disposed on a coupling 116 which connects the piston rod 113 to the valve stem 115. Thus, when the hydraulic actuator force tending to open the valve is eliminated upon a turbine trip, the springs 108 and 109, acting through spring seat 102, bar 104 and coupling 116, thrust the valve stem 115 downward, thereby closing the valve 100.

During maintenance and assembly of the valve 100, the springs 108 and 109 must be restrained so that the spring force does not prevent the coupling 116 from being operated to connect and disconnect the piston rod 113 from the valve stem 115. Accordingly, three lugs 112 are formed on the periphery of the spring seat 102. When it is necessary to assemble or disassemble the coupling 116, bolts 103 are inserted through the flange 101 and lugs 112 so that the spring seat 102 can be secured to the flange.

Experience has shown that the control valve 100 shown in FIGS. 1 and 2 suffers from several disadvantages. First, providing the spring seat 102 with the capability of sliding over the post 107 by connecting the spring seat to the coupling 116 via a bar 104 which extends through the window 106 in the post results in a complex design with an excessive number of components.

Second, the relatively small diameter of the post 107 makes it fairly flexible. As a result, the valve 100 can vibrate excessively, resulting in fatigue cracking of the valve stem 115. One approach to increasing the stiffness of the control valve is to replace the support post 107 with a can-type spring housing which encloses the springs 108 and 109. The increased diameter of the spring housing relative to the support post 107 imparts increased stiffness to the valve. Such an arrangement is shown in U.S. Pat. Nos. 3,602,261 (Brown et al.) and 4,834,133 (LaCoste et al.) both of which are assigned to the same assignee as the current invention and which are hereby incorporated by reference.

According to the approach used in the prior art, the can-type spring housing was bolted to the valve bonnet by screws arranged in a circle around the spring housing. Since the screws attaching the bonnet to the steam chest were also arranged in a circle around the spring housing, the diameter of the spring housing had to be considerably less than the diameter of the bonnet. As a result, the space available on the bonnet to increase the diameter of the spring housing was not optimally utilized. Accordingly, it would be desirable to provide a method of attaching the bonnet to the steam chest and the spring housing to the bonnet which allowed the spring housing diameter to be as large as possible.

One disadvantage of the can-type spring housing is that, due to the fact that the can-type spring housing encloses the springs, the spring seat must slide inside of the housing. As a result, separate restraining bars, which project through the windows and bolt to the spring seat, must be used to restrain the spring seat during assembly and disassembly of the coupling. This results in a multiplication of the number of components and increases the man-hours required to assemble or disassemble the coupling.

Accordingly, it would be desirable to provide a control valve having considerable stiffness yet which required a minimum number of components and which allowed the spring seat to be readily restrained.

SUMMARY OF THE INVENTION

It is an object of the current invention to provide a steam turbine having a control valve of increased stiffness.

It is a further object of the current invention that the increased stiffness be provided by incorporation of a valve spring housing.

It is still another object of the current invention that the spring seat of the control valve be capable of being readily restrained when assembling or disassembling the valve.

These and other objects are accomplished in a steam turbine having a steam chest and a steam control valve mounted thereon. The valve has (i) a valve stem assembly, (ii) a spring for applying a force to operate the valve, (iii) a bonnet having a spigot formed on its upper surface and mounted at its lower surface on an approximately planar surface on the steam chest by a plurality of screws arranged in a circle, (iv) a housing enclosing the spring and the circle of screws and having first and second flanges formed on its distal ends, (v) a spring seat having a circular disk portion from which integrally formed lugs extend and which is enclosed by the housing, and (vi) means for securing the lugs to the first flange. The housing has a longitudinally extending wall in which windows, through the lugs extend, are formed. The second flange of the housing is mounted on the bonnet upper surface by a plurality of screws encircling the housing and engaging a spigot formed in the bonnet.

DESCRIPTION OF THE PREFERRED EMBODIMENT

Figure 1:
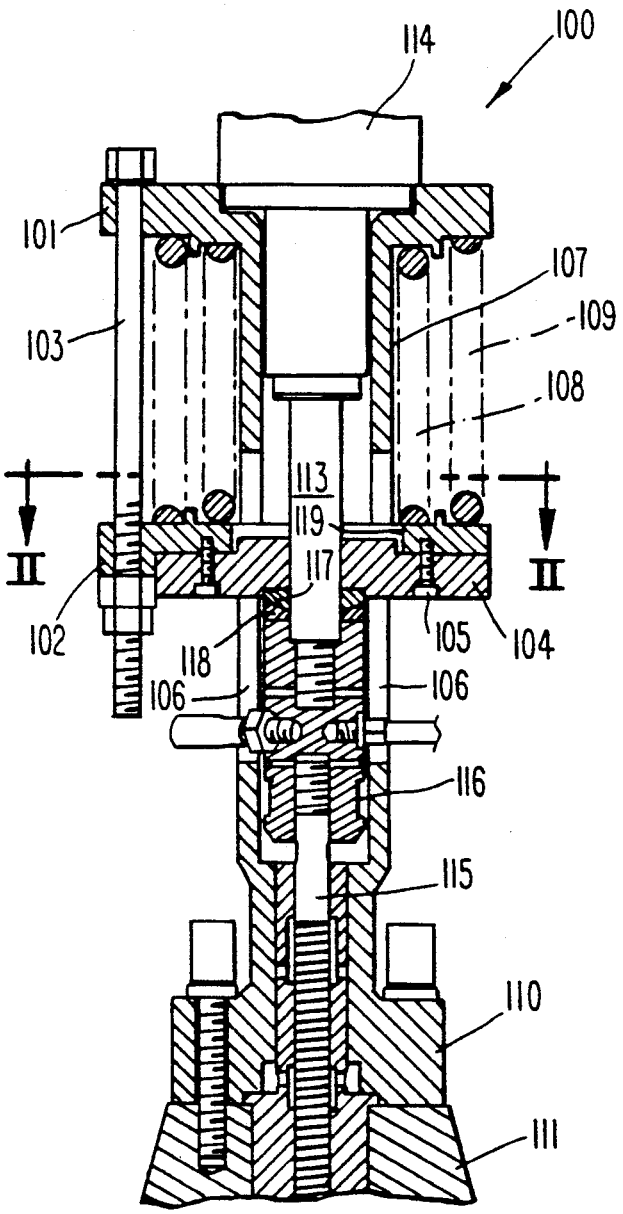
PRIOR ART Fig. 1
FIG. 1 is a longitudinal cross-section through a control valve according to the prior art.
Figure 2:
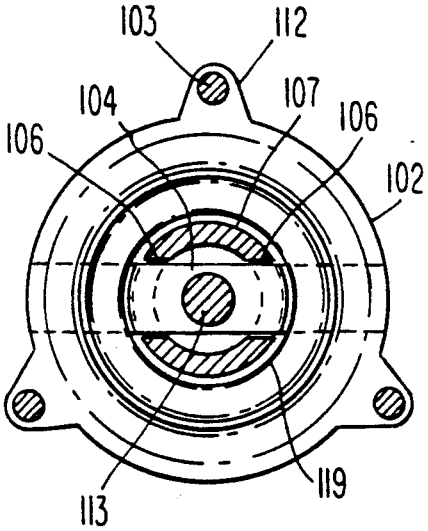
PRIOR ART Fig. 2
FIG. 2 is a cross-section through line II—II shown in FIG. 1, with the springs shown in phantom.
Figure 3:
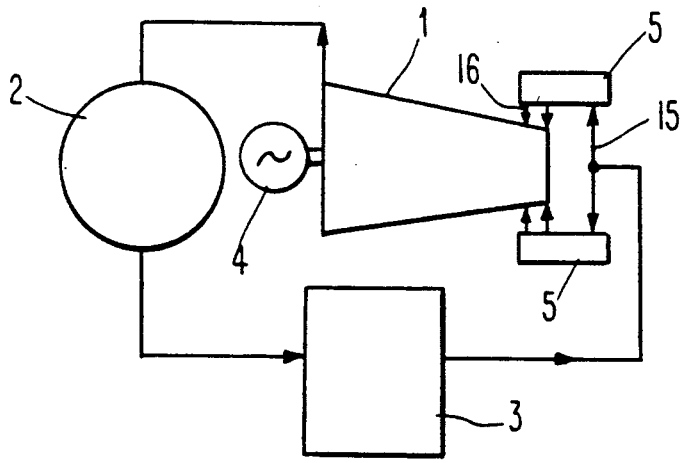
FIG. 3 is a schematic diagram of a steam turbine power plant.

There is shown in FIG. 3 a simplified schematic diagram of a steam turbine power plant. The major components of the plant are a steam turbine 1, a condenser 2, a boiler 3 and a generator 4. The boiler 3 converts feed water from the condenser 2 to steam. The steam is directed to the steam turbine 1 which drives the electrical generator 4. As shown in FIG. 3, the steam 15 from the boiler 3 is not supplied directly to the turbine 1. Instead, the steam 15 first flows through steam chests 5 so that the steam flow can be regulated. The steam 16 enters the turbine 1 from the steam chests 5.

Figure 4:
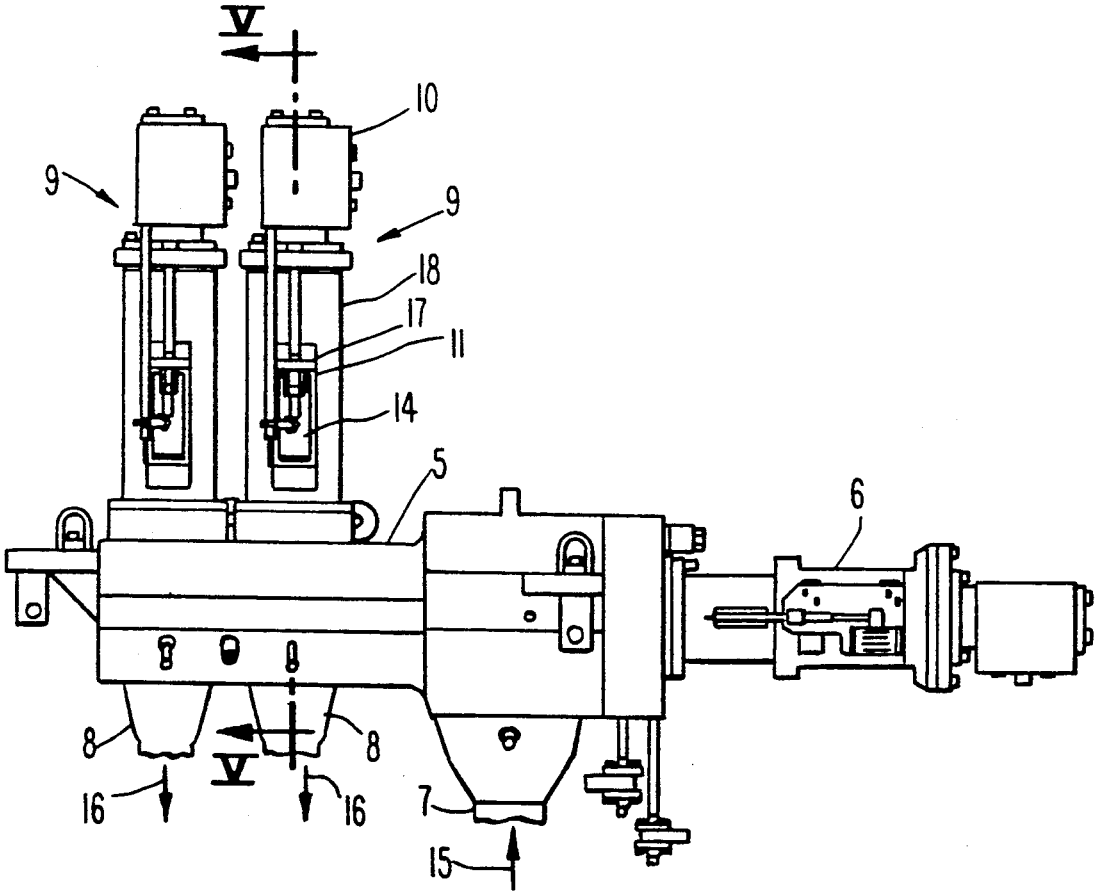
FIG. 4 is an elevation of one of the steam chests shown in FIG. 3.
Figure 5:
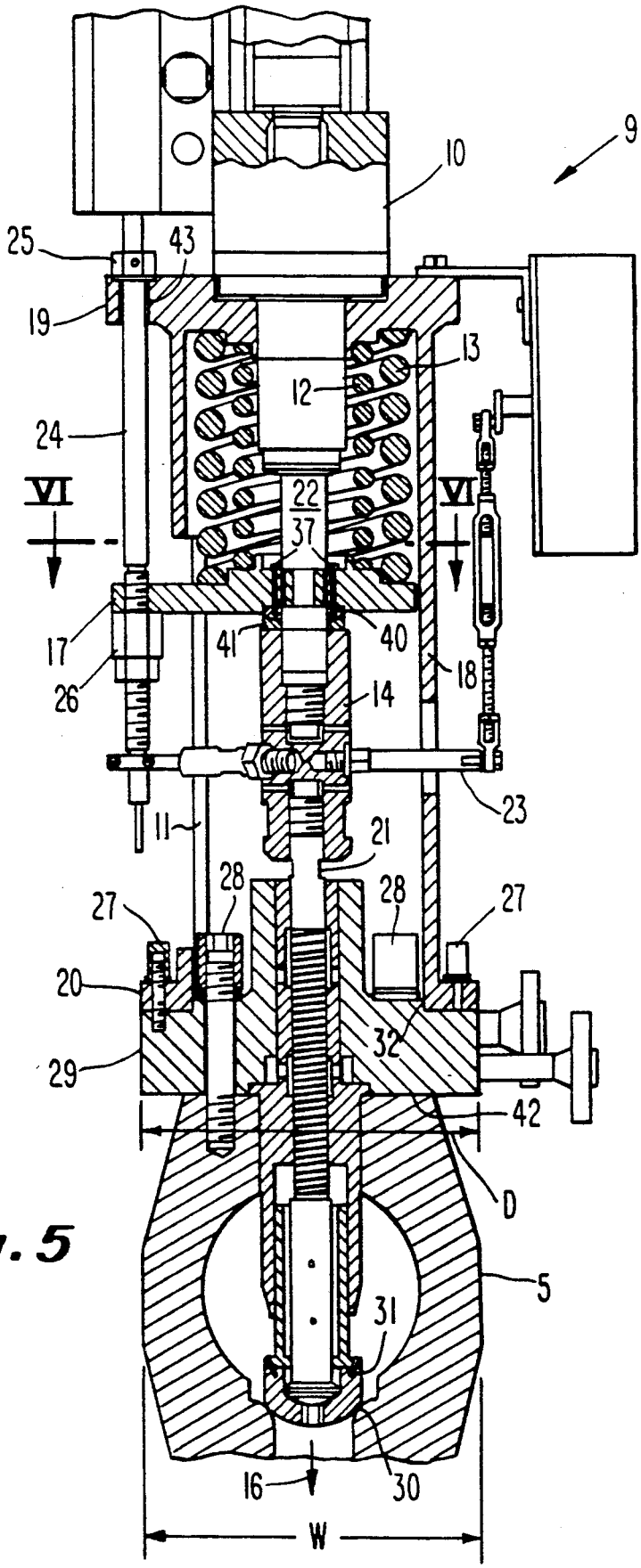
FIG. 5 is a cross-section through line V—V shown in FIG. 4.

As shown in FIGS. 4 and 5, each steam chest 5 is formed from an approximately cylindrically shaped vessel. A throttle valve 6 is disposed in one end of the steam chest 5 and receives the high pressure steam 15 from the boiler 3 via pipe 7. The admission of the throttled steam to the steam turbine is controlled by a series of control valves 9 mounted on an approximately planar surface 42 at the top of the steam chest 5. From the steam chest 5, the steam 16 is directed to the turbine casing (not shown) by pipes 8.

Figure 6:
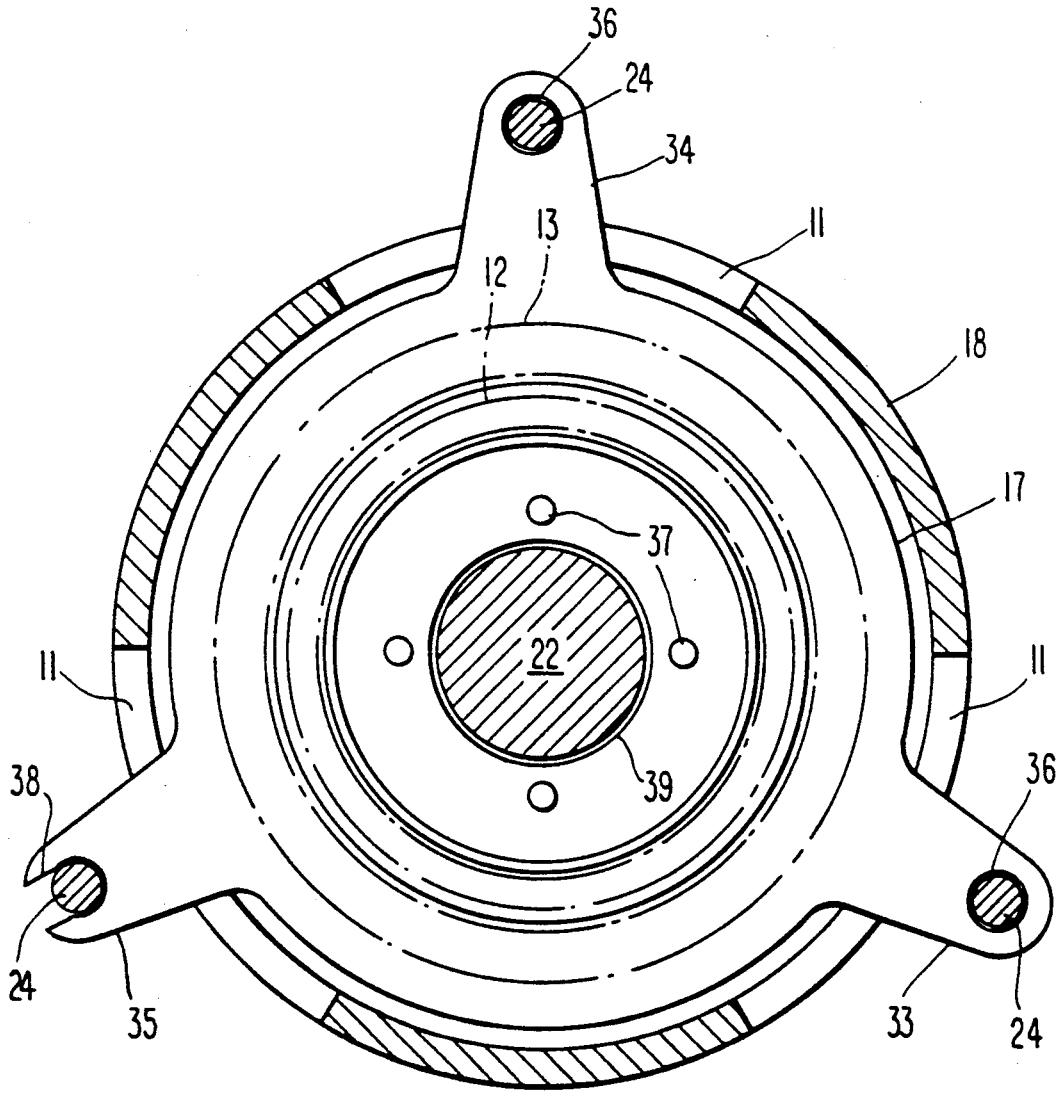
FIG. 6 is a cross-section through line VI—VI shown in FIG. 5.

As shown in FIGS. 5 and 6, a spring housing 18 is disposed within each control valve 9. The spring housing 18 has a flange 19 formed at its upper end on which a hydraulic actuator 10 is mounted. A piston rod 22 extends from the actuator 10 and is connected to a valve stem 21 by a coupling 14—the rod 22, coupling 14 and stem 21 forming a valve stem assembly. A plug 31 is attached to the end of the valve stem 21 and controls the flow of steam to the turbine by moving toward or away from a valve seat 30 formed in the steam chest 5.

As shown in FIG. 5, each control valve 9 is mounted on the steam chest mounting surface 42 by mating the approximately planar underside of the valve bonnet 29 thereto. The spring housing 18 is mounted at its lower flange 20 to the upper surface of the bonnet 29. According to the current invention, in order to maximize the diameter of the spring housing 18, and thereby maximize the stiffness of the valve 9, the bonnet 29 is oversized so that its outside diameter D is as least as great as the maximum width W of the steam chest 5 in a plane parallel to the plane of the bonnet 29 and the plane of the steam chest mounting surface 42, as shown in FIG. 5. This approach allows the bonnet 29 to have as large a diameter as possible without increasing the envelope of the steam chest 5.

In addition, the bonnet 29 is attached to the steam chest 5 by installing a plurality of socket head cap screws 28 arranged in a circle inside of a spring housing 18. The screws 28 extend through the bonnet 29 and into the steam chest 5. Note that by arranging the screws 28 which attach the bonnet 29 to the steam chest 5 within the spring housing 18, maximum use is made of the bonnet diameter for the purpose of increasing the spring housing diameter. Moreover, the spring housing 18 is attached to the bonnet 29 by a plurality of socket head screws 27 arranged in a circle around the outside of the spring housing and extending through the lower flange 20 into the bonnet. This arrangement results in the bolt circle around which the screws 27 are arranged having a large diameter, thereby increasing the stability of the spring housing 18/bonnet 29 joint and further increasing the stiffness of the valve 9.

Further stability is imparted to the spring housing 18/bonnet 29 joint by forming a spigot 32 in the upper face of the bonnet 29. According to the current invention, the inside diameter of the flange 20 is close to that of the outside diameter of the spigot 32, so that the flange engages the spigot in a tight fit. In the preferred embodiment, the maximum diameter of the flange is no more than 0.355 mm (0.014 inch) greater than the diameter of the spigot 32 to ensure a relatively tight fit.

As shown in FIGS. 5 and 6, inner and outer springs 12 and 13, respectively, are disposed between the upper flange 19 and a spring seat 17. The springs 12 and 13 encircle the piston rod 22 but are enclosed by the spring housing 18. The spring seat 17 slides within the spring housing 18. As shown in FIG. 6, three equally spaced integral lugs 33, 34 and 35 extend from the periphery of the disk-like central portion of the spring seat 17. These lugs extend through three equally spaced windows 11, each encompassing an approximately 60° arc, formed in the longitudinally extending cylindrical wall of the spring housing 18 so that the housing only partially encloses the spring seat 17.

As shown in FIG. 5, the spring seat 17 is attached to an annular washer 40 by screws 37. The washer 40 bears against a seat 41 mounted in a recess formed in the end of the coupling 14. Thus, upon de-actuation of the hydraulic cylinder 10 at a turbine trip, the springs 12 and 13 apply a force to the spring seat 17 which is transmitted to the valve stem 21 via washer 40, coupling seat 41 and coupling 14 so that the valve stem is rapidly driven downward causing the plug 31 to contact the valve seat 30, thereby preventing the admission of further steam to the turbine.

As previously discussed, the spring seat 17 must be restrained during assembly and disassembly of the valve 9 to allow the coupling 14 to be installed or removed. (Note that rotation of the coupling 14 during normal operation is prevented by an anti-rotation rod 23 which is threaded into the coupling and extends through a small axial slot in the spring housing 18.) According to the current invention, the spring seat 17 is restrained to the upper flange 19 by inserting a bolt 24 through each of three holes 43 in the upper flange 19 so that the heads 25 of the bolts rest on the upper surface of the flange and nuts 26, which are threaded onto the bolts, rest on the underside of the lugs 33–35 in the spring seat 17, as shown in FIG. 5.

As shown in FIG. 5, the bolts 24 extend through openings formed in each of the lugs 33–35. These openings are aligned along a common centerline with the holes 43 in the upper flange 19. In lugs 33 and 34 the opening is a hole 36 through the bolts 24 are inserted from above. Lug 35 is directly below the actuator 10 block so that access from above lug 35 is limited. Consequently, a slot 38 is formed in lug 35 to allow its bolt to be removed from the side without removing the actuator. The spring seat 17 is restrained against the spring force by tightening the nuts 26 against the underside of the spring seat. Thus, the separate spring seat and restraining bars used in prior art valves are replaced by a one-piece spring seat 17 having integrally formed lugs.

According to the current invention, the maximum width of the spring seat 17, as measured across the lugs, is less than the height of the windows 11. This allows the spring seat 17 to be initially installed in the spring housing 18 by rotating the seat 90 into the vertical orientation and inserting it into the spring housing through one of the windows 11. Thereafter, the spring seat 17 is rotated into the horizontal orientation and the bolts 24 and nuts 26 installed to restrain the spring seat.

As can be readily seen, the current invention results in a control valve which has sufficient stiffness to prevent excessive vibration yet which allows easy assembly and disassembly of the stem assembly coupling and which incorporates a relatively few number of components.

The present invention may be embodied in other specific forms without departing from the spirit or essential attributes thereof and, accordingly, reference should be made to the appended claims, rather than to the foregoing specification, as indicating the scope of the invention.

We claim:

1. A steam turbine, comprising:

(a) a steam chest; and (b) a steam control valve mounted on said steam chest, said valve having:

(i) a valve stem assembly;

(ii) a spring for applying a force to operate said valve;

(iii) a housing having a perimeter enclosing said spring, said housing having a longitudinally extending wall forming said perimeter and first and second distal ends, a first flange formed on said first distal end and a first window formed in a portion of said wall;

(iv) a spring seat at least partially enclosed by said housing and having an integrally formed lug extending through said first window beyond said housing perimeter, said spring seat being capable of being installed and removed through said first window, said spring seat having means for abutting said stem assembly, whereby said spring force is transmitted to said stem assembly; and (v) means disposed outside of said housing perimeter for securing said lug to said first flange;

and for taking said spring seat out of abutment with said stem assembly so as to remove said force transmitted from said spring to said stem assembly to allow disassembly of said stem assembly.

2. The steam turbine according to claim 1, wherein said spring seat is comprised of a center portion enclosed by said housing, said integrally formed lug extending from the periphery of said center portion.

3. The stem turbine according to claim 2, wherein said housing has second and third windows formed in said wall, each of said windows equally spaced around the periphery of said wall, and wherein said spring seat has second and third integrally formed lugs extending from the periphery of said center portion and through said second and third windows, respectively.

4. The steam turbine according to claim 2, wherein said spring seat has a centrally formed hole through which said stem assembly extends.

5. The steam turbine according to claim 4, wherein said stem assembly comprises a coupling and wherein said force transmitting means comprises means for transmitting said spring force to said coupling.

6. The steam turbine according to claim 5, wherein said spring seat center portion is an approximately circular member.

7. The steam turbine according to claim 1, wherein said lug and said first flange each have a commonly aligned hole formed therein, and wherein said securing means comprises a bolt extending through said hole in said flange and said hole in said lug.

8. The steam turbine according to claim 1, wherein said housing further comprises a second flange formed on said second distal end and wherein said valve further comprises a bonnet mounted on said steam chest, said second flange mounted on said bonnet.

9. The steam turbine according to claim 8, wherein said bonnet has a spigot formed therein, said second flange engaging said spigot.

10. The steam turbine according to claim 9, wherein said flange has an inside diameter and said spigot has an outside diameter, the dimension of said inside diameter being greater than said outside diameter by no more than 0.355 mm (0.014inch).

11. The steam turbine according to claim 8, wherein said steam chest has a planar surface on which said bonnet is mounted, and wherein the diameter of said bonnet is at least as great as the maximum width of said steam chest in a plane parallel to said steam chest planar surface.

12. The steam turbine according to claim 1, wherein said housing is approximately cylindrical.

13. The steam turbine according to claim 1, wherein said spring seat has a maximum width defined at said lug, and wherein said window has a length greater than said maximum width of said spring seat, whereby said spring seat can be inserted into said housing through said window.

14. A steam turbine, comprising:

(a) a steam chest having a mounting surface; and (b) a plurality of steam control valves mounted on said steam chest mounting surface, each of said valves having:

(i) a valve stem assembly;

(ii) a spring for applying a force to said valve stem assembly;

(iii) an approximately cylindrical housing enclosing said spring, said housing having a distal end on which a flange is formed and a longitudinally extending wall in a portion of which a window is formed;

(iv) a bonnet having upper and lower mounting surfaces, said lower mounting surface in contact with said steam chest mounting surface, said flange mounted on said upper mounting surface;

(v) a plurality of first screws extending through said bonnet into said steam chest, said first screws arranged in a pattern within said housing;

(vi) a plurality of second screws extending through said flange into said bonnet, said second screws arranged in a pattern encircling said housing; and (vii) a spring seat at least partially enclosed by said housing and abutting said valve stem assembly so as to transmit said spring force thereto, said spring seat having an integrally formed lug and means for securing said lug to said housing and for taking said spring seat out of abutment with said stem assembly so as to remove said spring force from said stem assembly during assembly and disassembly of said valve stem assembly, said spring seat extending through said window beyond said housing and being capable of being installed and removed through said window.

15. The steam turbine according to claim 14, wherein a spigot is formed in said bonnet upper mounting surface, the inside diameter of said flange mating with said spigot and being no more than 0.355 mm (0.014 inch) greater than the diameter of said spigot.

16. The steam turbine according to claim 14, wherein said steam chest mounting surface is approximately planar, and wherein the outside diameter of said bonnet is at least as great as the maximum width of said steam chest in a plane parallel to said steam chest mounting surface.

17. A steam turbine comprising:

(a) a steam chest having an approximately planar mounting surface; and (b) a steam control valve mounted on said steam chest mounting surface, said valve having:

(i) a valve stem assembly;

(ii) a spring for applying a force to said valve stem assembly;

(iii) an approximately cylindrical housing having a perimeter enclosing said spring, said housing having a longitudinally extending wall forming said perimeter and first and second distal ends, first and second flanges formed on said first and second distal ends, respectively, a hole formed in said first flange, and a window formed in a portion of said wall;

(iv) a spring seat at least partially enclosed by said housing and having an integrally formed lug extending through said window beyond said housing perimeter, said spring seat being capable of being installed and removed through said window, said lug having a hole formed therein commonly aligned with said hole in said first flange, said spring seat having means for abutting said stem assembly, thereby transmitting said force form said spring to said stem assembly;

(v) means disposed outside of said housing perimeter for securing said lug to said first flange and for taking said spring seat out of abutment with said stem assembly so as to remove said force transmitted from said spring to said stem assembly to allow disassembly of said stem assembly;

(vi) a bonnet mounted on said steam chest mounting surface, said second flange mounted on said bonnet;

(vii) a plurality of first screws extending through said bonnet into said steam chest, said first screws arranged in a pattern within said housing; and (viii) a plurality of second screws extending through said flange into said bonnet, said second screws arranged in a pattern encircling said housing.

* * * * *